US007891129B2

(12) United States Patent
Parry, Jr. et al.

(10) Patent No.: US 7,891,129 B2
(45) Date of Patent: Feb. 22, 2011

(54) COMPRESSIBLE PLUG FOR A MAGAZINE WELL

(75) Inventors: David Parry, Jr., Yardley, PA (US); Daniel Parry, Dublin, PA (US); Daniel Smith, Hatboro, PA (US)

(73) Assignee: Techline Technologies, Inc., Willow Grove, PA (US)

( * ) Notice: Subject to any disclaimer, the term of this patent is extended or adjusted under 35 U.S.C. 154(b) by 315 days.

(21) Appl. No.: 12/168,213

(22) Filed: Jul. 7, 2008

(65) Prior Publication Data

US 2010/0281748 A1 Nov. 11, 2010

(51) Int. Cl.
*F41A 35/02* (2006.01)

(52) U.S. Cl. ..... 42/96

(58) Field of Classification Search ..... 42/49.01, 42/49.02, 70.02, 83, 85, 90, 96; 138/89; 215/358; 220/233
See application file for complete search history.

(56) References Cited

U.S. PATENT DOCUMENTS

| | | | | |
|---|---|---|---|---|
| 4,528,765 | A | 7/1985 | Johnson | |
| 4,605,140 | A * | 8/1986 | Koors | 220/233 |
| 4,619,062 | A | 10/1986 | Johnson | |
| 4,628,627 | A | 12/1986 | Johnson | |
| 4,709,496 | A | 12/1987 | Johnson | |
| 4,896,447 | A * | 1/1990 | Badoni | 42/95 |
| 5,014,866 | A * | 5/1991 | Moore | 215/364 |
| 5,208,937 | A * | 5/1993 | Cooper | 15/104.062 |
| 5,518,033 | A * | 5/1996 | Webster | 138/90 |
| 5,782,029 | A | 7/1998 | Brooks | |
| 6,032,695 | A * | 3/2000 | Wellen et al. | 138/89 |
| D427,274 | S | 6/2000 | Hicks | |
| 6,256,920 | B1 * | 7/2001 | Olson | 42/70.11 |
| 6,536,152 | B1 * | 3/2003 | Wisz | 42/71.01 |
| 2006/0185658 | A1 * | 8/2006 | Stevens | 124/80 |
| 2010/0071242 | A1 * | 3/2010 | Lesenfants | 42/49.02 |

* cited by examiner

*Primary Examiner*—Bret Hayes
(74) *Attorney, Agent, or Firm*—Michael Crilly, Esq.

(57) ABSTRACT

A magazine well plug used to render a weapon safe and/or to prevent sand, water, and other contaminants from entering a weapon is described. The magazine well plug includes a main body substantially shaped to conform to the interior of a magazine well, an optional flange substantially disposed about the main body, and an optional grip element disposed at one end of the main body facilitating insertion and removal of the plug with respect to the magazine well. The main body and flange are comprised of one or more compressible materials. The main body is dimensionally larger than one or more dimensions within a magazine well so as to require the main body to be compressed in part or whole when inserted into a magazine well. The invention avoids openings inherent with rigid plugs, thereby preventing solid and/or liquid contaminants from entering a magazine well.

16 Claims, 7 Drawing Sheets

COMPRESSIBLE PLUG FOR A MAGAZINE WELL

CROSS REFERENCE TO RELATED APPLICATIONS

None.

FEDERALLY SPONSORED RESEARCH AND DEVELOPMENT

None.

BACKGROUND OF THE INVENTION

1. Field of the Invention

The invention generally relates to a device used to render a weapon safe by preventing the insertion of a magazine with live ammunition into its magazine well and to prevent sand, water, and other contaminants from entering a weapon through its magazine well. Specifically, the invention is a plug composed of a compressible material dimensionally larger than the interior of a magazine well so that insertion of the plug into the well requires compression of the plug.

2. Background

Current military operations in Iraq and Afghanistan highlight problems pertaining to the security and maintainability of magazine-fed personal weapons, non-limiting examples including rifles and handguns. In one example, operational protocols prohibit soldiers from carrying loaded firearms within areas deemed safe zones and where dignitaries are present. Accordingly, soldiers are not permitted to engage magazines to firearms, even when empty. An open magazine well allows dirt, sand, water, and other contaminants to enter the well, thereafter fouling components which are critical to proper function of a weapon.

The related arts include several noteworthy devices.

In U.S. Pat. Nos. 4,528,765 and 4,709,496, Johnson describes safety devices for use with firearms having a magazine well for holding a removable magazine. Devices prevent a firearm from being unintentionally fired and are color coded to indicate when a firearm is in a safe condition. Devices include a body dimensionally smaller than the magazine well so as to allow for the insertion and removal of the device without binding. Devices are composed of a durable high density plastic with sufficient strength to prevent deformation which might permit dirt to enter the magazine well. Each device includes a detent for interacting with a magazine retention latch on a firearm to secure the device within a magazine well.

In U.S. Pat. No. 4,619,062, Johnson describes a safety device for a repeating firearm including a main body which fits in a magazine well of a firearm, closing its outer end. An outer end of the main body is clearly visible at the end of the magazine well when the main body is properly located therein. A chamber-blocking member movably attached to the main body excludes cartridges from the firing chamber of the weapon and, in one embodiment of the invention, includes a barrier which prevents a firing pin from reaching the primer of a cartridge which may be located in the firing chamber undetected.

Devices described by Johnson and others are mechanically complex, difficult to manufacture, cumbersome to use, ineffective, impractical, and/or unable to prevent liquid from infiltrating into a magazine well.

As is readily apparent from the discussions above, the related arts do not include a plug comprised of a compressible material that is dimensionally larger than a magazine well so as to require compression of the plug for proper insertion into a well.

Accordingly, what is required is a compressible plug which is capable of rendering a weapon safe by preventing insertion of a magazine with live rounds into its magazine well and/or to prevent solid and liquid contaminants from entering a weapon through its magazine well.

SUMMARY OF THE INVENTION

An object of the invention is to provide a compressible plug which must be compressed for proper insertion into a magazine well.

A further object of the invention is to provide a compressible plug that compresses snugly into a magazine well, thereby securing the plug therein.

A further object of the invention is to provide a compressible plug capable of rendering a weapon safe by preventing insertion of a magazine with live rounds into a magazine well.

Another object of the invention is to provide a compressible plug capable of preventing solid and liquid contaminants from entering a weapon through its magazine well.

In accordance with an embodiment of the invention, the magazine well plug includes a main body substantially shaped to conform to the interior of a magazine well, an optional flange substantially disposed about the main body, and an optional grip element at one end of the main body facilitating insertion and removal of the plug with respect to the magazine well. The main body and flange are comprised of one or more readily compressible materials, examples including, but not limited to, rubbers, polymers, elastomers, and foams. The main body is dimensionally larger than one or more dimensions of the void within a magazine well. As such, the main body must be compressed in part or whole when inserted into a magazine well.

In some embodiments, the main body and flange could be comprised of one or more materials that generally resist compression and quickly return to a shape that conforms to the shape of the magazine well and its opening, respectively.

In other embodiments, the main body and flange could be comprised of one or more materials that slowly return to a shape that conforms to the shape of the magazine well and its opening, respectively.

In yet other embodiments, the main body could include a cavity that enhances the compression characteristics of the main body.

In still other embodiments, the compressible materials could be porous.

In further embodiments, the main body and/or flange could form a liquid tight seal to prevent water and other liquids from entering a magazine well.

In yet further embodiments, the magazine well plug either glows or reflects when exposed to light or is color coded.

In preferred embodiments, the magazine well plug could be composed of a compressible rubber that is slightly larger than the dimensions of a magazine well, resulting in a firm friction fit inside the well. A large handle is provided along the lower end of the plug so as to enable a soldier to quickly locate and remove the protective plug as needed. A transition between plug and flange further prevents contaminants from entering the well. The shape of the magazine well plug conforms neatly to the underside of a firearm so as not to interfere with the normal routines of a soldier. The plug could glow after exposure to light and/or reflect visible or invisible light to visually indicate to others within an area that the weapon does not contain live rounds.

Several advantages are offered by the described invention. The invention avoids openings between a magazine well and an otherwise rigid plug, thereby minimizing the likelihood of solid and/or liquid contaminants from entering a magazine well. The invention is easily manufactured via presently known fabrication methods. The invention is easy to use and requires no formal training. The invention is easily cleaned with resources available to a soldier.

REFERENCE NUMERALS

1 Magazine well plug
2 Main body
3 Flange
4 Grip element
5 Cavity
6 Side
7 Side
8 Side
9 Side
10 Protrusion
11 Length
12 Height
13 Angle
14 Width
15 Width
16 Length
17 First end
18Second end
19 Diagonal lengt
20 Firearm
21 Magazine well
22 Well
23 Wall
24 Wall
25 Wall
26 Wall
27 Well length
28 Opening
29 Angle
30 Well width
31 Well height
32 Transition

BRIEF DESCRIPTION OF THE DRAWINGS

The invention will now be described in more detail, by way of example only, with reference to the accompanying drawings, in which.

DETAILED DESCRIPTION OF THE INVENTION

Figure 1:
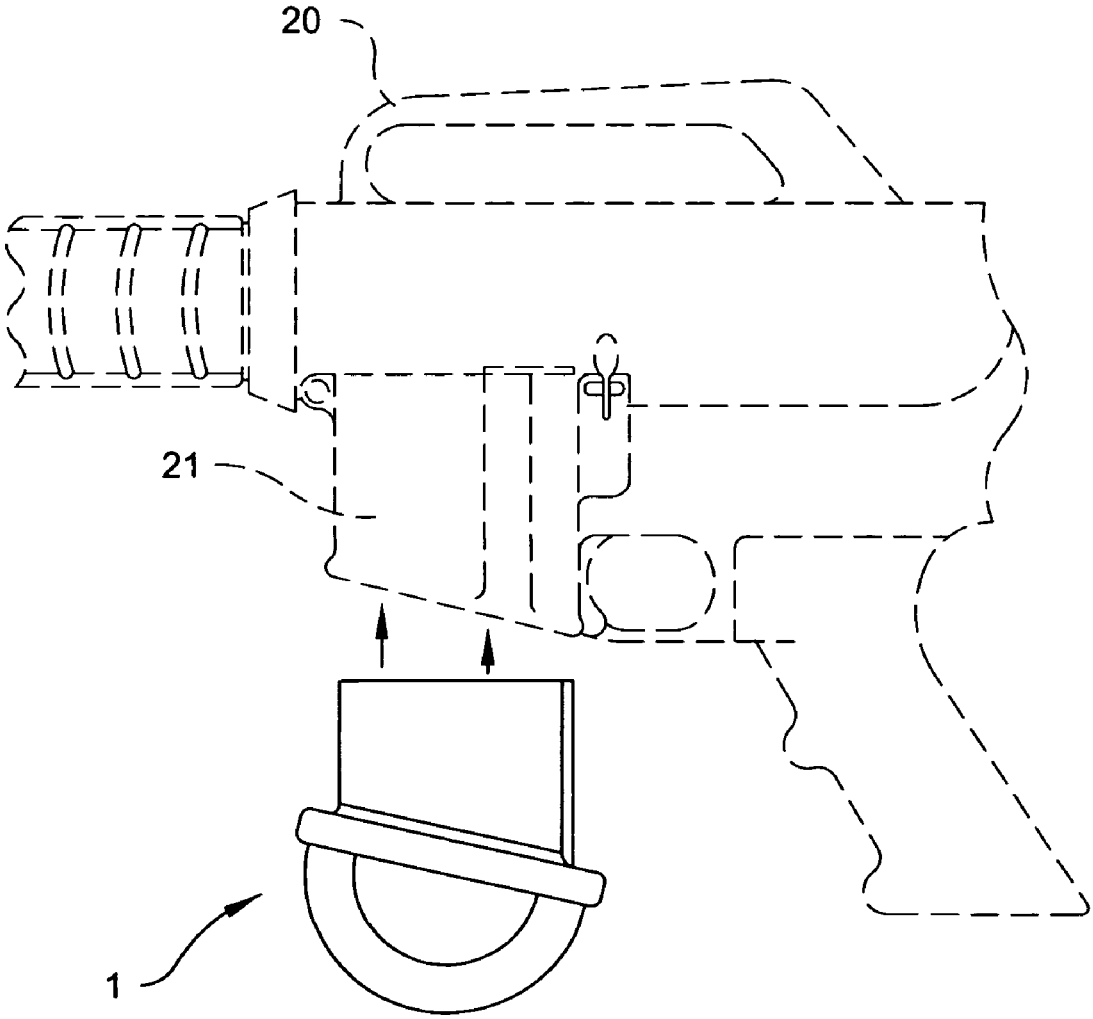
FIG. 1 is a side elevation view illustrating a magazine well plug prior to insertion into a firearm in accordance with an embodiment of the invention.

Referring now to FIG. 1, an embodiment of the magazine well plug 1 is shown adjacent to a magazine well 21 of an exemplary firearm 20. The magazine well plug 1 is inserted into the magazine well 21, so as to substantially fill the volume otherwise occupied by a magazine with ammunition. For purposes of the present description, the term firearm 20 is broadly understood to include weapons having a cavity into which a magazine or the like is loaded.

Figure 4:
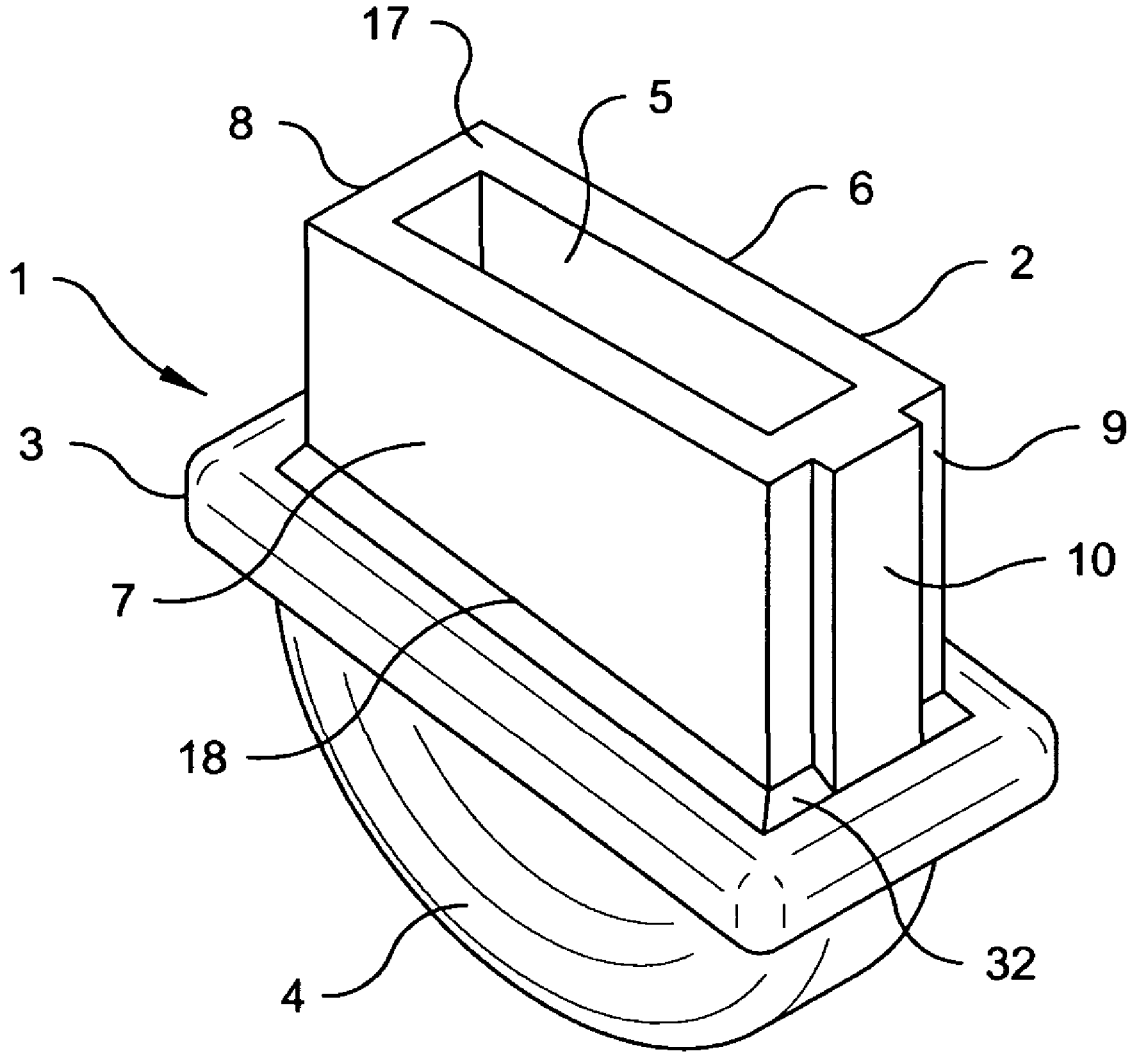
FIG. 4 is a perspective view illustrating a preferred embodiment of a magazine well plug in accordance with the invention.

Referring now to FIG. 4, the magazine well plug 1 is shown including a main body 2, a flange 3, and a grip element 4. Main body 2 and flange 3 are comprised of one or more compressible materials, preferably compositions which resist degradation by ultraviolet light, as well as by solvents, lubricants, and other chemicals commonly used with firearms 20. Exemplary compressible materials include, but are not limited to, rubbers, polymers, elastomers, and foams. Compressible materials could include compositions which compress but are generally resistive of such behavior and quickly recover after compression. It is also possible for compressible materials to include compositions which are generally less resistive of compression and have a slower recovery period. Specific examples of a compressible material are urethane rubber and silicone rubber. Compressible materials could be porous, including open and closed cell structures, or have one or more cavities 5 that optimize the compression and recovery characteristics of the magazine well plug 1. Main body 2, flange 3, and grip element 4 could be fabricated separately or as a single unit via known molding or forming methods used for compressible materials.

Figure 2:
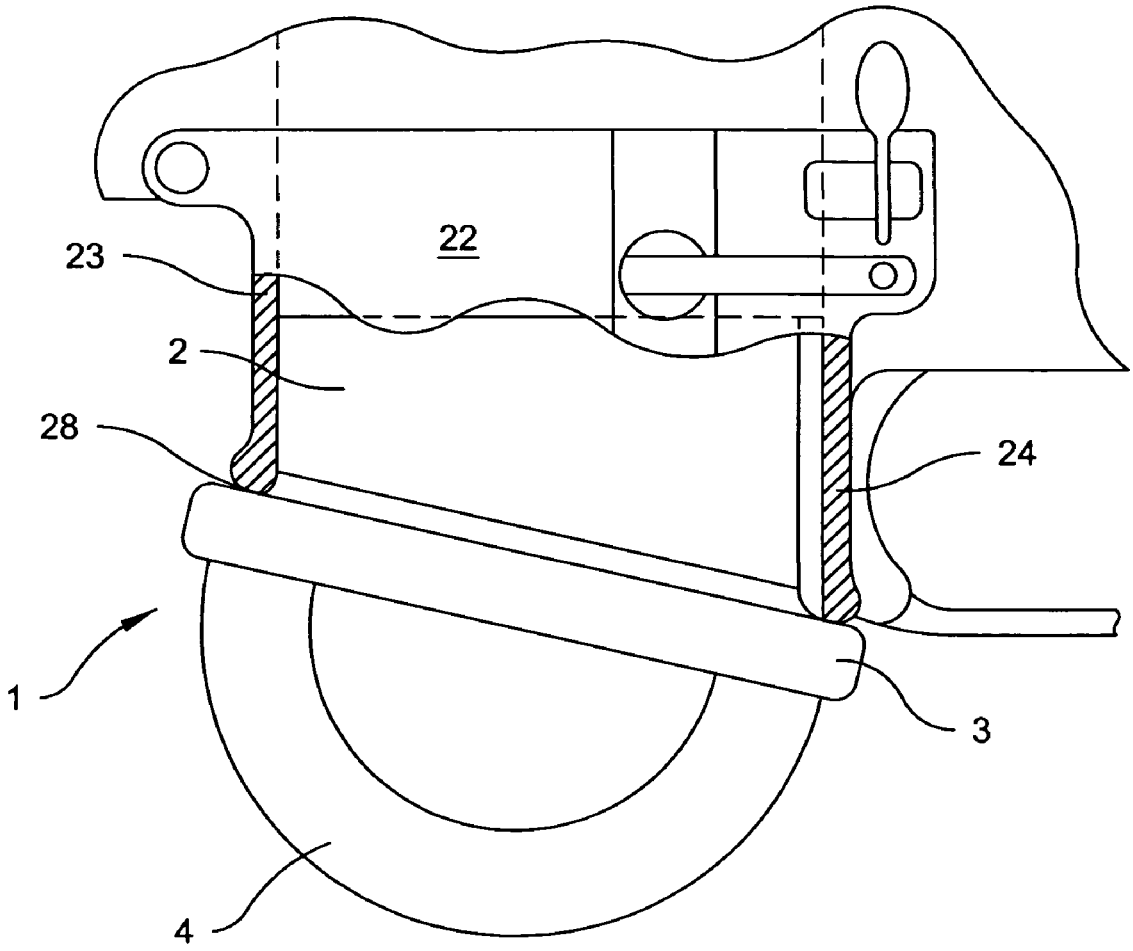
FIG. 2 is an enlarged side elevation view illustrating a magazine well plug in accordance with an embodiment of the invention and partial cut away view of a magazine well to illustrate attachment of the magazine well plug thereto.
Figure 3:
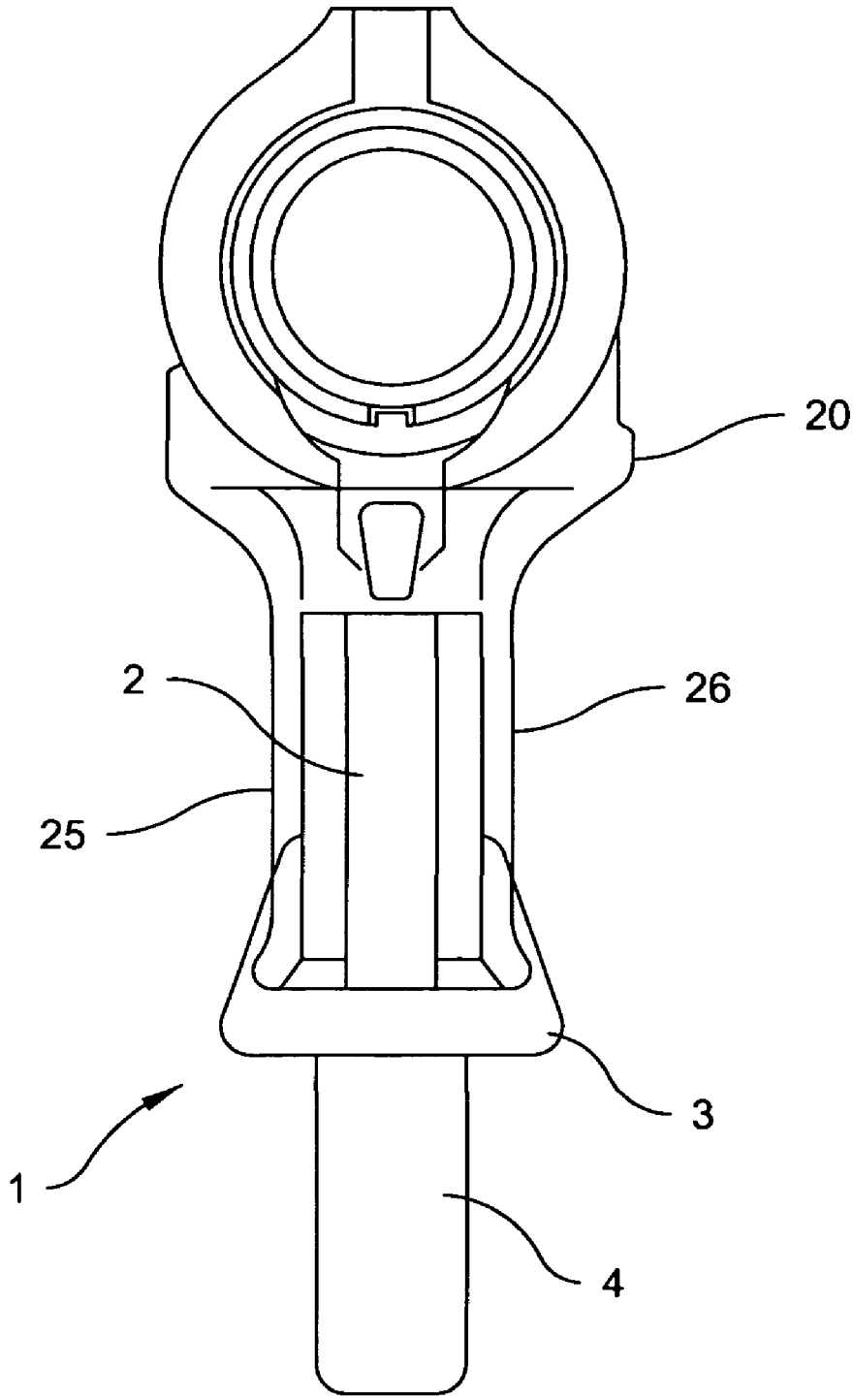
FIG. 3 is front elevation view illustrating a magazine well plug in accordance with an embodiment of the invention and partial cut away view of a magazine well to illustrate attachment of the magazine well plug thereto.

Referring now to FIGS. 2-4, the main body 2 is shown having a generally rectangular shape with four planar-shaped sides 6-9 disposed between a planar-shaped first end 17 and a planar-shaped second end 18. However, the main body 2 could be composed of other shapes including, but not limited to, polygons, circles, and ellipses with planar and non-planar features. In some embodiments, the main body 2 could include one or more protrusions 10 which extend beyond one or more sides 6-9. Protrusions 10 could include planar or non-planar shapes which compliment features within a well 22 or improve insertion and removal characteristics of the magazine well plug 1. For example, a plurality of hemispherical-shaped elements could be disposed along the sides 6-9 of a main body 2, so as to reduce the interference area between the main body 2 and magazine walls 23-26, while securely fastening the magazine well plug 1 within the well 22. When protrusions 10 compliment features within a well 22, the dimensions of the protrusions 10 are preferred to slightly exceed those of the well feature.

Figure 6:
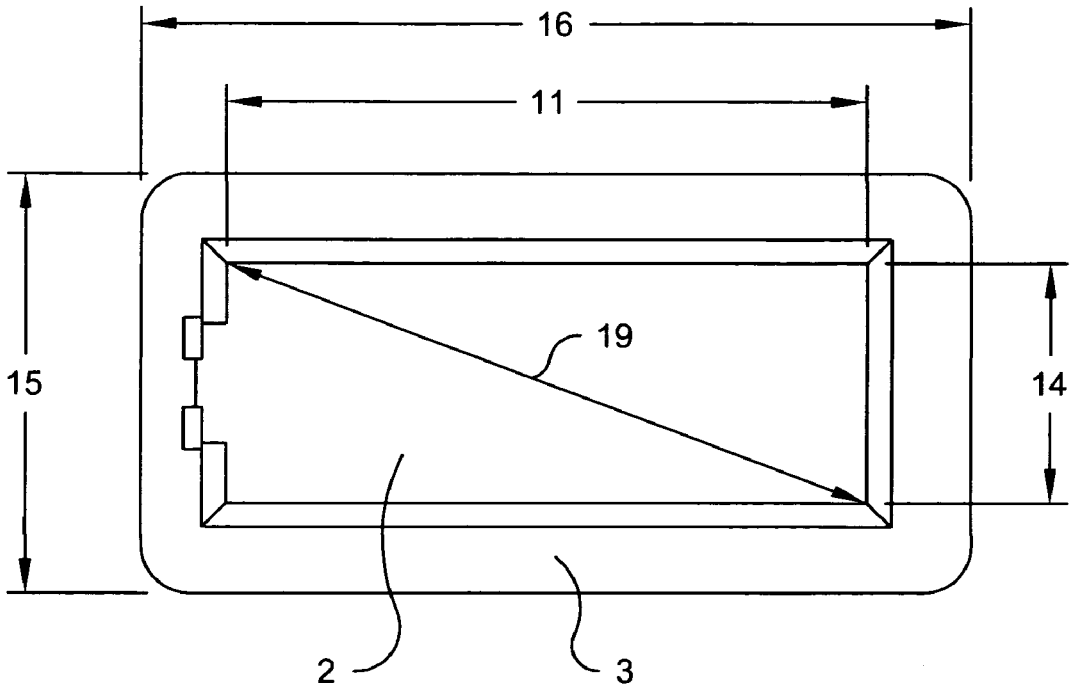
FIG. 6 is a top view illustrating a magazine well plug in accordance with an embodiment of the invention.

The flange 3 is a generally planar structure which traverses the perimeter of the main body 2 and protrudes from the sides 6-9. FIG. 6 shows the width 15 and length 16 of the flange 3 to be greater than the corresponding width 14 and length 11 of the main body 2. In some embodiments, the flange 3 could partially traverse the perimeter of the main body 2. In preferred embodiments, the flange 3 is disposed about the main body 2 at or adjacent to the second end 18, as represented in FIG. 4. In other embodiments, a transition 32, an example being a chamfer or other tapered structure, is provided between the sides 6-9 and flange 3 to avoid right angles or sharp transitions which might otherwise compromise the sealing characteristics of the main body 2 and/or flange 3 within the well 22 and/or opening 28.

The grip element 4 is a shaped element generally disposed adjacent to or along the second end 18 of the main body 2 that facilitates insertion and removal of the magazine well plug 1 with respect to well 22. The grip element 4 could be a circular-shaped handle or the like, as represented in FIG. 2, or have another shape which functions as a grip that allows a user to grasp, insert, and remove a magazine well plug 1. The grip element 4 could be composed of one or more compressible materials, as described above, or include a semi-rigid or rigid material formed, fastened, or adhered to the main body 2

Referring again to FIGS. 2 and 3, the magazine well plug 1 is shown seated snugly within a well 22. In preferred embodiments, the main body 2 should conform to the shape formed by the walls 23-26 within and/or opening 28 into the well 22 so as to seal the well 22 from the outside environment. In other embodiments, the compressibility of the flange 3 could also function to conform to the shape of the opening 28 into the well 22.

The main body 2 contacts the walls 23-26 along the well 22 and exerts a force against at least two walls 23-26. This force is the result of the recovery of the main body 2 to its original shape within the well 22. As such, the magazine well plug 1 employs at least the recovery force to secure it within a magazine well 21.

Referring again to FIGS. 1-4, the magazine well plug 1 is inserted into the magazine well 21 by grasping the grip element 4 with one hand, placing the first end 17 onto the opening 28 and applying a force in a rocking motion in the direction of the well 22. The applied force causes the main body 2 to compress as it contacts and slides past the opening 28. The force is applied until the flange 3 contacts the opening 28 and is properly seated thereon. In other embodiments, the user could manually compress the main body 2 adjacent to the opening 28 with a second hand so as to reduce the sliding friction between main body 2 and opening 28 and walls 23-26. Removal of the magazine well plug 1 is performed by grasping the grip element 4 with one hand and applying a force in a rocking motion in a direction opposite of the magazine well 21. The user might be required to manually compress the main body 2 adjacent to the opening 28 with a second hand so as to reduce the sliding resistance between main body 2 and opening 28 and walls 23-26.

Figure 5:
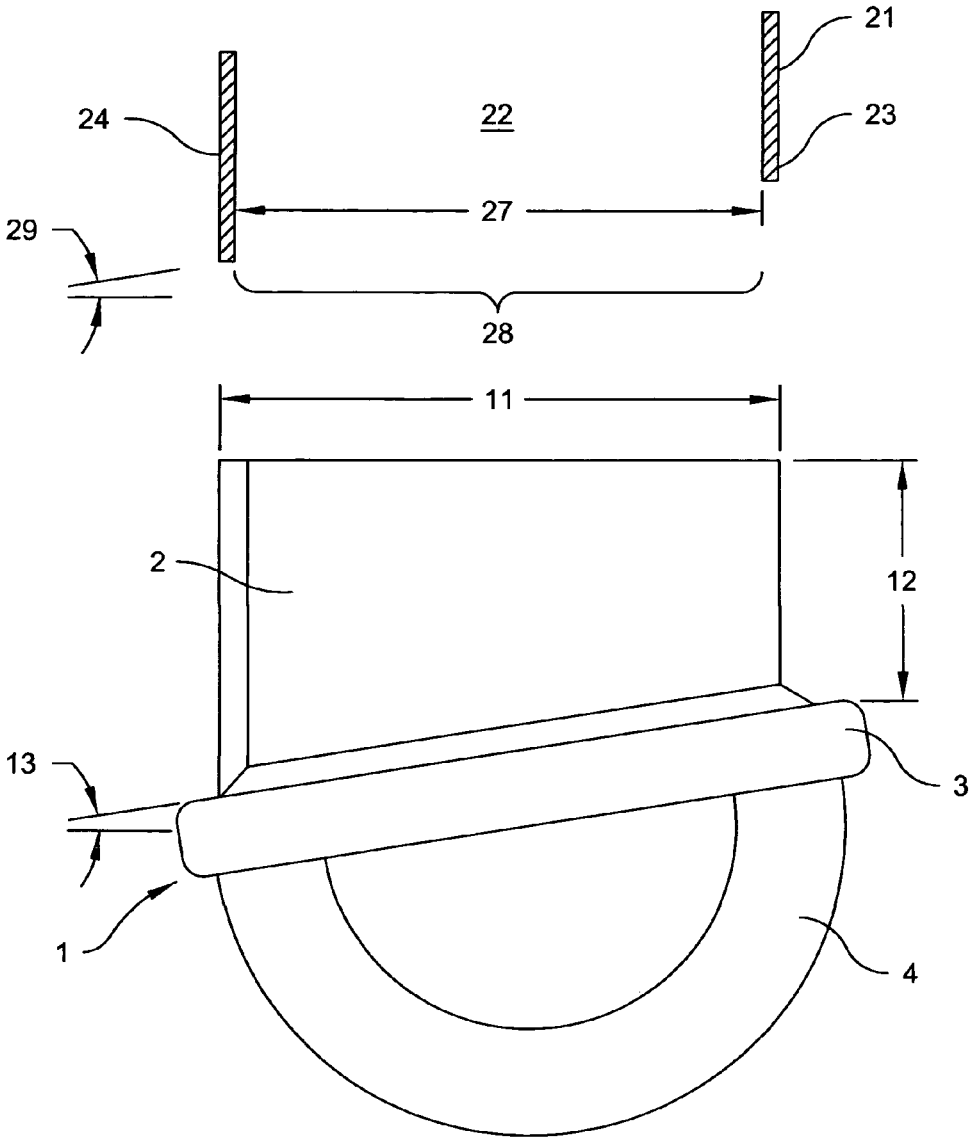
FIG. 5 is a side elevation view illustrating a magazine well plug in accordance with an embodiment of the invention and cut away view of a magazine well to illustrate dimensional differences between plug and well.

Referring now to FIG. 5, the major axis of the main body 2 is shown having a length 11 dimensionally greater than the dimension of the well length 27. In preferred embodiments, the difference in lengths should provide at least an interference fit between the walls 23, 24 and main body 2. The compressibility of the main body 2 should at least allow for contraction of its length 11 to that of the well length 27. The height 12 of the main body 2 should be sufficient to ensure contact along the interior surfaces of the walls 23-26 so as to form a continuous seal about the well 22. In some embodiments, the height 12 could be minimized to reduce the sliding resistance and corresponding difficulty to seat and remove the magazine well plug 1 into and from the well 22. In other embodiments, the height 12 could be maximized to ensure contact between the main body 2 and one or more elements in the breech to prevent operation of the firearm 20. In yet other embodiments, the height 12 could be maximized to ensure sufficient grip or frictional forces between the main body 2 and walls 23-26 to further ensure the magazine well plug 1 is securely lodged within the well 22. In still other embodiments, the main body 2 should substantially fill the well 22 and have a height 12 at least as great as the well height 31.

The flange 3 could be disposed in a variety of orientations. In some embodiments, the flange 3 could be arranged parallel to the centerline of the gun barrel. In preferred embodiments, the flange 3 is disposed at an angle 13 which approximates the angle 29 formed by the walls 23-26 comprising the magazine well 21. This arrangement ensures contact and seal between the flange 3 and magazine well 21 about the opening 28. In some embodiments, the flange 3 could provide the only seal with the magazine well 21 or compliment the seal provided by the main body 2.

Figure 7:
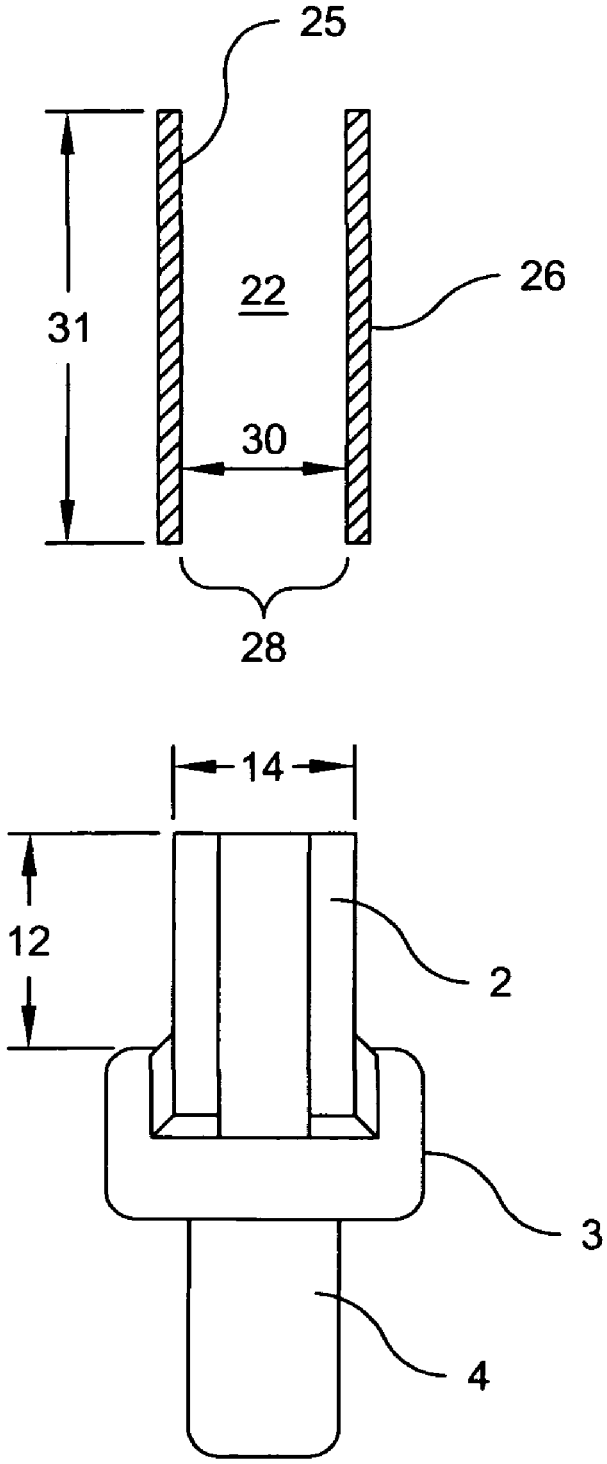
FIG. 7 is a front elevation view illustrating a magazine well plug in accordance with an embodiment of the invention and cut away view of a magazine well to illustrate dimensional differences between plug and well.

Referring now to FIG. 7, the minor axis of the main body 2 is shown having a width 14 dimensionally greater than the dimension of the well width 30. In preferred embodiments, the difference in widths should provide at least an interference fit between the walls 25, 26 and main body 2. The compressibility of the main body 2 should at least allow for contraction of its width 14 to that of the well width 30.

While the length 11 and/or width 14 dimensions of the main body 2 could exceed the corresponding dimensions of the well 22, other designs are possible. For example, it is likewise possible for one or more diagonal lengths 19 along the main body 2, as shown in FIG. 6, to exceed corresponding dimensions within the well 22. It is also possible for one or more protrusions 10 in combination or in conjunction with one or more sides 6-9 to provide the interference required to securely lock the magazine well plug 1 within the magazine well 21.

In some embodiments, it might be advantageous to enhance the visible characteristics of the magazine well plug 1. In one example, the magazine well plug 1 could glow after exposure to visible or invisible light so that the plug is clearly identifiable at night or under poor lighting conditions. In another example, the magazine well plug 1 could reflect visible or invisible light so that the plug is clearly identifiable when illuminated or viewed via night vision equipment.

In some embodiments, glow and/or reflective properties could be achieved by paint or the like applied onto the exterior of the magazine well plug 1. In other embodiments, one or more commercially available additives could be mixed into the composition prior to molding or forming the magazine well plug 1. In yet other embodiments, a glow and/or reflective appliqué may be applied onto the exterior of a magazine well plug 1 and adhesively or mechanically attached thereto.

The description above indicates that a great degree of flexibility is offered in terms of the present invention. Although various embodiments have been described in considerable detail with reference to certain preferred versions thereof, other versions are possible. Therefore, the spirit and scope of the appended claims should not be limited to the description of the preferred versions contained herein.

What is claimed is:

1. A magazine well plug for a firearm having a magazine well capable of holding a magazine comprising:

(a) a main body composed of at least one compressible material and having one or more initial dimensions larger than one or more dimensions defined between two or more interior walls of said magazine well prior to installation into said magazine well of said firearm, wherein said main body is in a compressed state when disposed within said magazine well, said main body dimensionally conforms to said interior walls of said magazine well and exerts a force onto said interior walls of said magazine well as said main body attempts to recover said initial dimensions while disposed within said magazine well, said main body preventing insertion of said magazine into said magazine well of said firearm when said main body is disposed within said magazine well; and (b) a grip element at one end of said main body for facilitating removal of said main body from said magazine well.

2. The magazine well plug of claim 1, wherein said main body has at least one cavity or is porous.

3. The magazine well plug of claim 1, wherein said main body prevents sand or dirt from entering said magazine well.

4. The magazine well plug of claim 1, further comprising:

(c) at least one protrusion disposed along and extending from said main body.

5. The magazine well plug of claim 1, wherein said magazine well plug glows after exposure to visible or invisible light.

6. The magazine well plug of claim 1, further comprising:

(c) a flange substantially disposed about said main body, said flange comprised of said at least one compressible material.

7. The magazine well plug of claim 6, wherein said main body has at least one cavity or is porous.

8. The magazine well plug of claim 6, wherein said flange prevents sand or dirt from entering said magazine well.

9. The magazine well plug of claim 6, wherein said flange is disposed at an angle.

10. The magazine well plug of claim 6, further comprising:

(d) at least one protrusion disposed along and extending from said main body.

11. The magazine well plug of claim 6, wherein said magazine well plug glows after exposure to visible or invisible light.

12. A magazine well plug for a firearm having a magazine well capable of holding a magazine comprising:

(a) a main body composed of at least one compressible material and having one or more initial dimensions larger than one or more dimensions defined between two or more interior walls of said magazine well prior to installation into said magazine well of said firearm, wherein said main body is in a compressed state when disposed within said magazine well, said main body dimensionally conform to said interior walls of said magazine well and exerts a force onto said interior walls of said magazine well as said main body attempts to recover said initial dimensions while disposed within said magazine well, said main body preventing insertion of said magazine into said magazine well of said firearm when said main body is disposed within said magazine well; and (b) a flange substantially disposed about said main body.

13. The magazine well plug of claim 12, wherein said main body has at least one cavity or is porous.

14. The magazine well plug of claim 12, wherein said main body and/or said flange prevents a liquid from entering said magazine well.

15. The magazine well plug of claim 12, wherein said main body further comprising:

(c) at least one protrusion disposed along and extending from said main body.

16. The magazine well plug of claim 12, wherein said magazine well plug glows after exposure to visible or invisible light.

* * * * *